US005291716A

United States Patent [19]

Broberg et al.

[11] Patent Number: 5,291,716

[45] Date of Patent: Mar. 8, 1994

[54] METHOD FOR ERECTING BUILDINGS, AND STRUCTURAL ASSEMBLY FOR CARRYING OUT THE METHOD

[76] Inventors: Peter O. Broberg, Norra Kyrkogränden 5, S-261 31 Landskrona, Sweden; Find Madsen, Skovsvinget 15, DK-3480 Fredensborg; Jorgen H. Christensen, Drodensvei 10, DK-2791 Dragor, both of Denmark

[21] Appl. No.: 838,805

[22] PCT Filed: Oct. 5, 1990

[86] PCT No.: PCT/SE90/00642

§ 371 Date: Mar. 19, 1992

§ 102(e) Date: Mar. 19, 1992

[87] PCT Pub. No.: WO91/05118

PCT Pub. Date: Apr. 18, 1991

[30] Foreign Application Priority Data

Oct. 6, 1989 [SE] Sweden ..... 8903284

[51] Int. Cl.[5] ..... E04B 1/348

[52] U.S. Cl. ..... 52/745.03; 52/79.2; 52/79.12; 52/731.3; 52/281

[58] Field of Search ..... 52/741.1, 745.03, 79.2, 52/79.12, 263, 281, 282, 79.11, 79.13, 731.2, 731.3, 731.7

[56] References Cited

U.S. PATENT DOCUMENTS 3,706,169 12/1972 Rensch ..... 52/263
3,831,332 8/1974 Weese .
3,861,093 1/1975 Robinson .
3,903,664 9/1975 Doriel .
4,205,497 6/1980 Schirm ..... 52/731.2
4,599,840 7/1986 Ingvarsson et al. ..... 52/340
4,630,417 12/1986 Collier ..... 52/263
5,022,209 6/1991 Kimura ..... 52/263

FOREIGN PATENT DOCUMENTS 2219202 10/1973 Fed. Rep. of Germany .
2093146 1/1972 France .

*Primary Examiner*—Carl D. Friedman
*Assistant Examiner*—Kien Nguyen
*Attorney, Agent, or Firm*—Beveridge, DeGrandi, Weilacher & Young

[57] ABSTRACT

A method for erecting buildings is characterized in that cassettes (10) made in a form between sectional elements (11) are positioned, at the building site, in such manner that the sectional elements (11) are close to one another and together define vertical cavities in which preferably concrete is injected to form supporting columns. Horizontal beams (23) are joined to the sectional elements (11) to be connected to the supporting columns when these are being cast, thereby to achieve a structural skeleton. A structural assembly for carrying out this method comprises cassettes (10) made in a form between sectional elements (11). The sectional elements (11) serve as supporting means when the cassette (10) is handled, and as a form for producing supporting columns after the cassettes (10) have been positioned at the building site. Preferably, the sectional elements (11) are made of sheet metal and have recesses (16, 18) for receiving horizontal beams (23) which are joined to the supporting columns when these are being cast.

11 Claims, 6 Drawing Sheets

Figure 1:
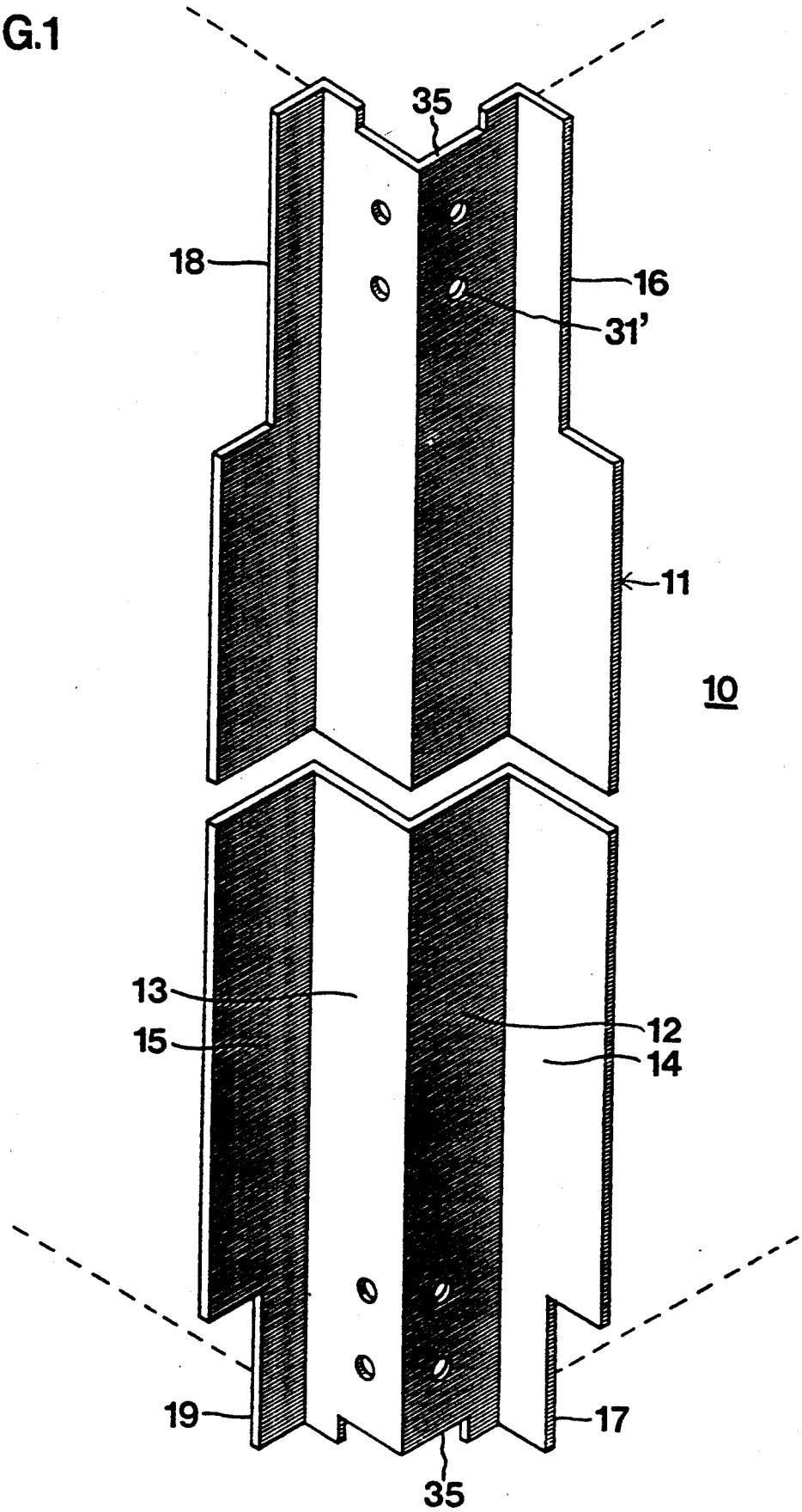

METHOD FOR ERECTING BUILDINGS, AND STRUCTURAL ASSEMBLY FOR CARRYING OUT THE METHOD

The present invention relates to a method for erecting buildings, in which room-forming cassettes of polygonal horizontal section, preferably rectangular ones, are made in a form between at least two vertically oriented sectional elements which are fixedly connected to the cassette and have longitudinal flanges projecting from the periphery of the cassette, and a desired number of cassettes are arranged in one or more planes on a prepared foundation at the building site, the sectional elements of adjacent cassettes being positioned close to or in the vicinity of one another, such that the flanges together define a vertical cavity.

In recent years, efforts have been made to lower the building costs by rationalising conventional building techniques. Usually, units or modules are manufactured in factories from where they are transported to the building site where they are joined to an on-site built structural skeleton of concrete or steel. In most cases, the rationalisation gains have, however, proved to be much smaller than expected, and some experts further maintain that complete on-site construction is still the least expensive method. The reason for this is not absolutely clear, but one explanation might be that the large manufacturing tolerances used in these contexts necessitate extensive and costly adjusting operations at the building site to fit together the modules and the skeleton as well as the modules between themselves.

One method currently used aims at producing turnkey units by manufacturing room-sized volume elements, thereby locating most of the building operations to the factories. This method has led to the production of light cassettes suitable for use in low buildings where the fire-protection regulations are less severe, or for placing on structural skeletons in higher buildings. Also heavy cassettes, e.g. self-supporting ones of concrete, have been produced. These cassettes require no special structural skeletons.

In both cases, however, problems are encountered. The structural skeleton of the light cassettes has often required advanced building designs and complex assemblage points. The heavy cassettes, on the other hand, have necessitated different designing because these cassettes support one another.

The inventive idea is to use the modules for making the structural skeleton, which is quite the reverse of first producing a skeleton and then joining the modules thereto. Thus, it is now possible to produce the structural skeleton at a comparatively low cost while avoiding the fitting problems mentioned before. A great advantage is that the cassettes can be made as completely standardised industrial products, thereby solving the usual designing problems when building structural skeletons and cassettes.

The implemented inventive idea is characterised in that the end portions of horizontal beams are placed in recesses provided therefor in the flanges of the sectional elements, and that a column-forming material, preferably concrete, is applied in the vertical cavity defined by said flanges, so as to engage the horizontal beams to form supporting columns which, together with the horizontal beams, constitute a supporting and stabilising structural skeleton with rigid asssemblage points.

Thus, the cassette is the nucleus in this context. Therefore, it is important that it be made with great accuracy, i.e. in a form between at least two vertically oriented sectional elements. The cassette is always made according to given system dimensions, but can be equipped to comply with customers' requirements. The sectional elements may be of any suitable material, although sheet metal is the most suitable one, since these sectional elements, besides forming part of the supporting and stabilising assembly of the cassette in production and handling, merely serve as a form in the subsequent production of supporting columns at the building site, i.e. they have no supporting function in the finished building, except that of transmitting forces between the ceiling and bottom frames of the cassettes to the supporting columns in the final structure.

The invention also concerns a structural assembly for erecting buildings, which comprises room-forming cassettes and intermediate supporting means and in which the cassettes, which preferably are of rectangular horizontal section, are made in a form between at least two vertically oriented sectional elements which are fixedly connected to the cassette and have flanges projecting from the periphery thereof. This assembly is characterised in that the sectional elements are of a comparatively thin-walled material, have recesses for receiving horizontal beams, and are positionable close to or in the vicinity of one another to form a cavity in which a column-forming material is applicable conjointly with beams positioned in the recesses, to form a supporting and stabilising structural skeleton with rigid assemblage points.

Figure 2:
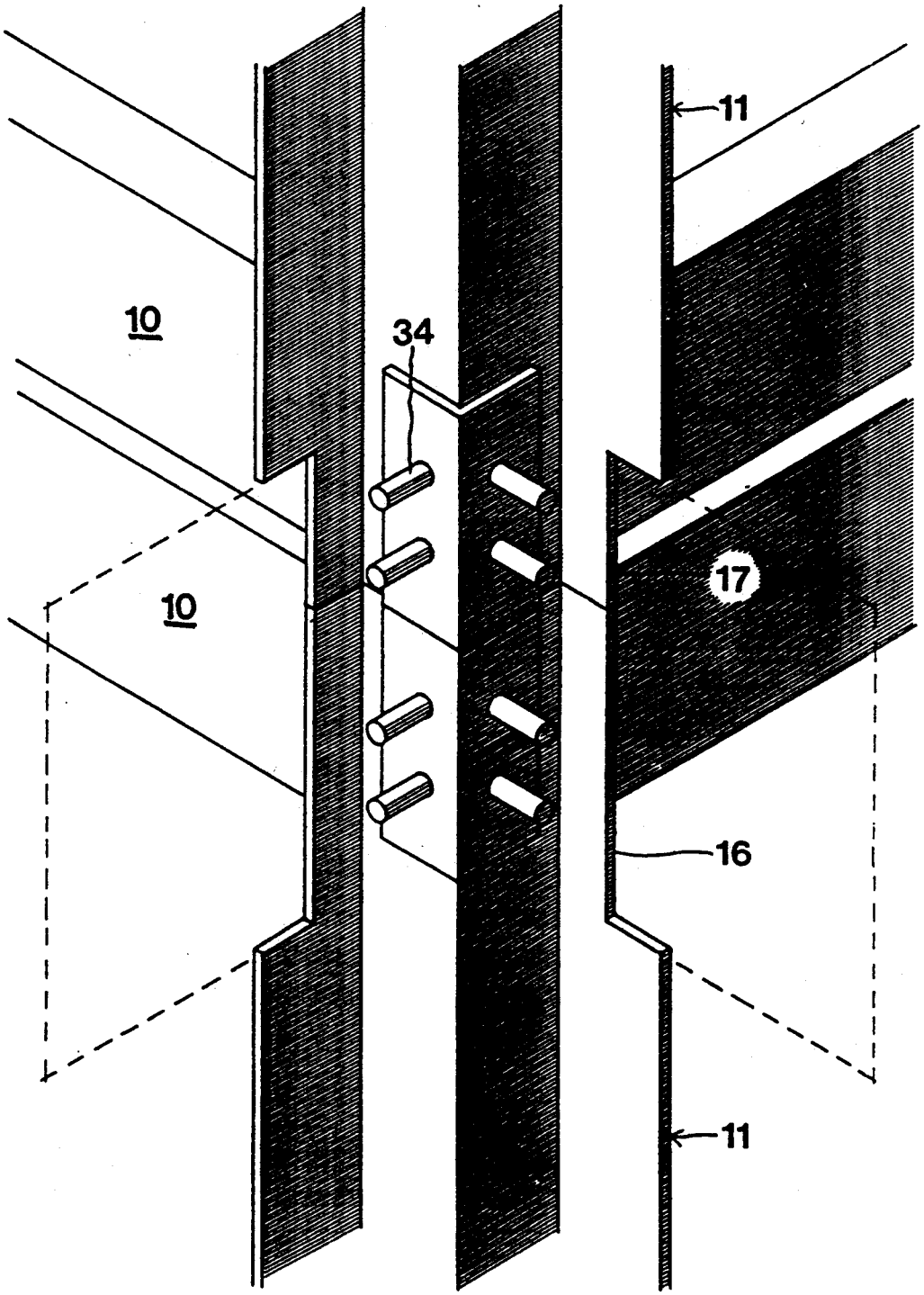
Figure 4:
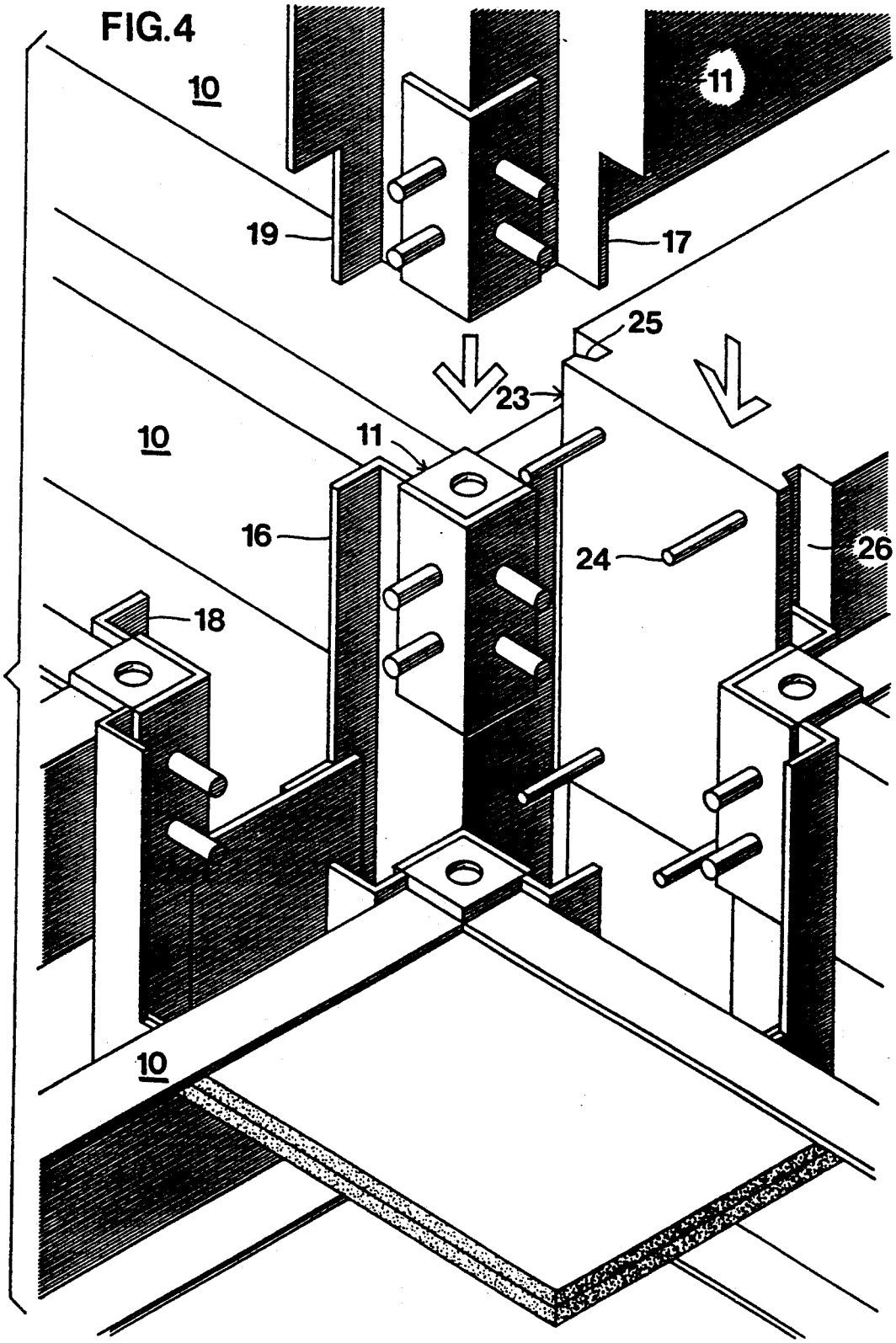
Figure 5:
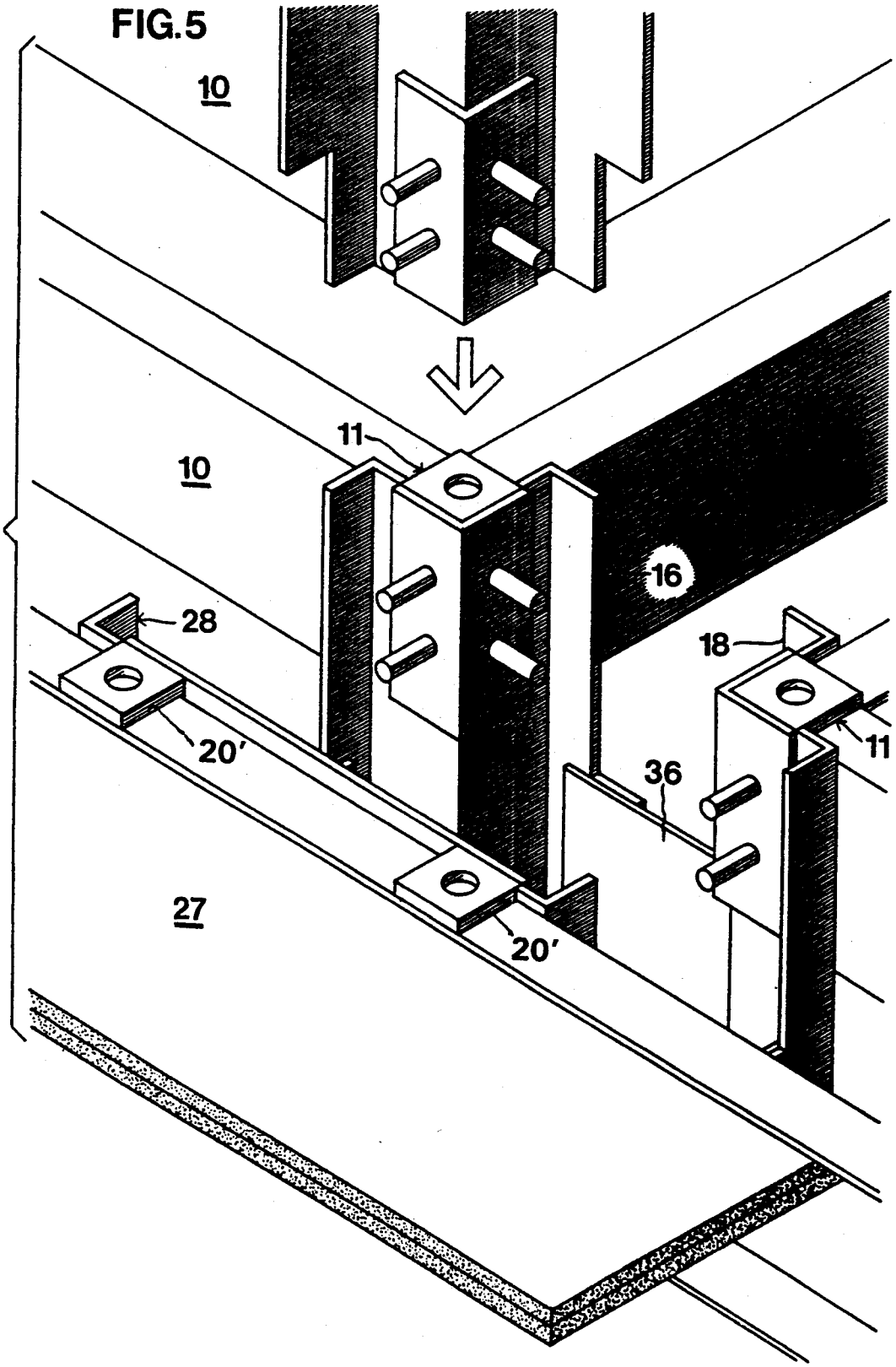
Figure 6:
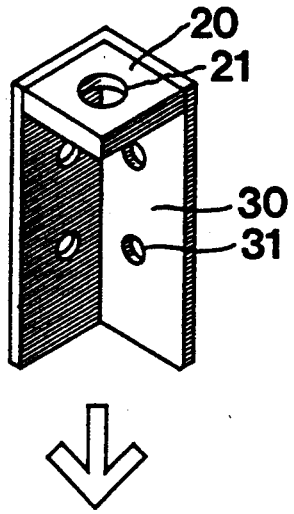
Figure 7:
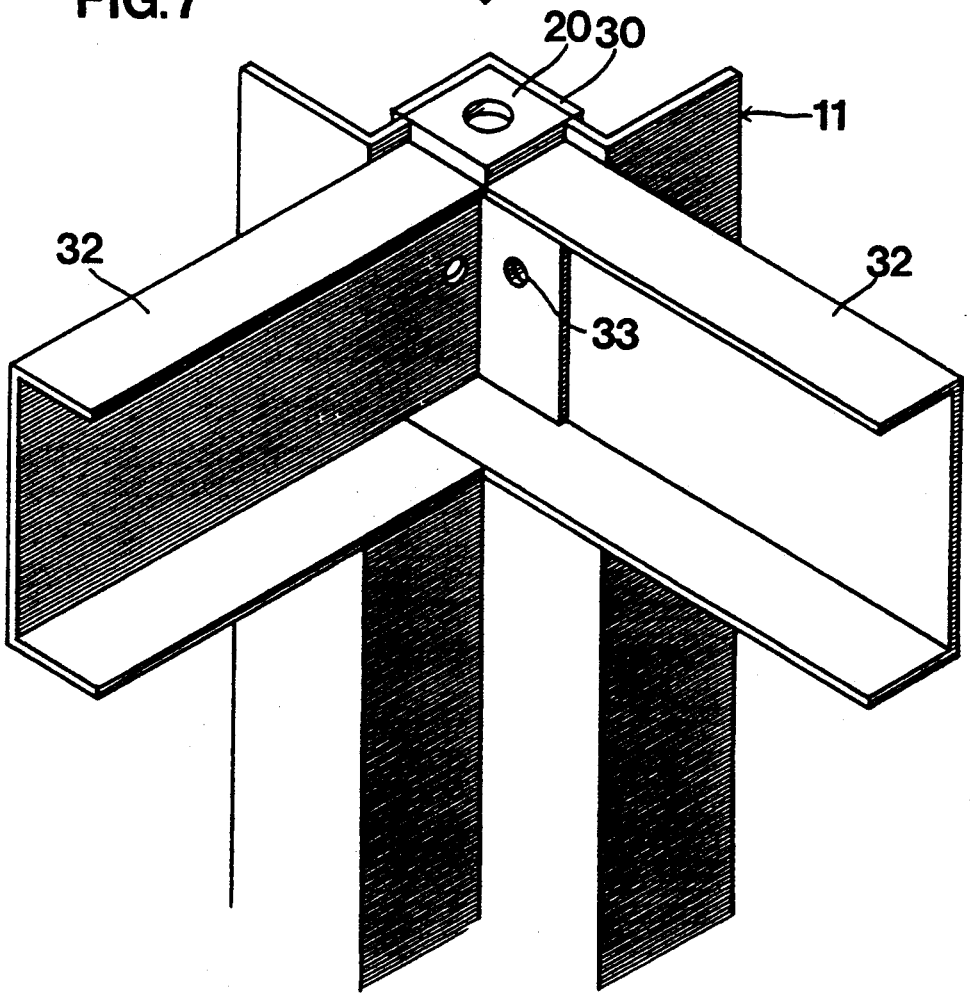

The invention will be described in more detail below with reference to the accompanying drawings which are perspective views of embodiments of the invention. In the drawings, FIG. 1 illustrates a corner portion of a cassette and a sectional element enclosing this corner, FIG. 2 illustrates two cassettes according to FIG. 1, one of which is placed on top of the other, FIG. 3 illustrates four cassettes according to FIG. 1, which are arranged on the same floor level adjacent to one another, with the sectional elements of the cassettes defining a vertical cavity, and a further cassette which is to be placed on top of one of the first-mentioned cassettes, FIG. 4 corresponds to FIG. 3, but in addition illustrates a horizontal beam positioned between two adjacent cassettes, FIG. 5 illustrates two cassettes which are to be connected to an existing wall or another cassette, and a third cassette to be placed on top of one of the two first-mentioned cassettes, and FIG. 6 illustrates a sectional insert which, in FIG. 7, is mounted on a sectional element.

As indicated above, the invention is based on a specific use of cassettes 10, which are manufactured elsewhere than the building site, preferably in a factory, thereby profiting from the rational materials handling in factories. Here, the cassettes are tailor-made according to customer's requirements, and equipped with the necessary components. Thus, one cassette may be intended to have, in a finished building, a special, e.g. acoustic, insulation, whereas the other cassettes of the building only require a simpler insulation. The cassettes are always given the same dimensions and design, but are adapted to different functions. This does not affect manufacturing standardisation. The cassettes can be equipped differently, e.g. as wet-room cassettes, dwelling-room cassettes as well as cassettes to serve as large-size rooms. If so desired, all the cassettes can be delivered under a turn-key contract, so that they are ready for use as soon as they have been finally positioned. In its simplest form, the cassette is made up of an upper and a lower boundary plane, forming the ceiling and the floor, respectively, and four sectional elements keeping these planes apart. Additionally, the cassette may have one, two, three or four walls. Normally, the cassette is of rectangular horizontal section, but other shapes are, of course, conceivable.

To make it possible to carry out the inventive method, the cassettes must be manufactured within accurate tolerances, for which reason they are made in a form between sectional elements. One sectional element intended for the cassette corners is designated 11 in the drawings. Although only sectional elements for the cassette corners are shown in the drawings, the cassettes may however be equipped with other sectional elements between the corners, e.g. U-shaped ones. The sectional elements can be made of any suitable material, but, for reasons of costs, they are preferably made of comparatively thin sheet metal, e.g. below 1–5 mm, depending on the material chosen. The cross-section of the sectional element 11 roughly has the shape of a W with four flanges 12, 13, 14 and 15 which, as can be seen, are perpendicular to one another. The cassette corner is received between the centre flanges 12, 13 of the sectional element, which means that the two flanges 14, 15 project at right angles from the associated cassette side. The corners between the long side of the flanges 14, 15 facing away from the cassette and the short sides of the flanges have been cut off to form orthogonal recesses, of which the upper are designated 16, 18 and the lower are designated 17, 19. As can be seen, the vertical side of the recesses 16–19 is parallel to the long sides of the flanges, whereas their horizontal side is parallel to the short sides of the sectional element. At the top and at the bottom, the centre flanges 12, 13 are closed by means of an insert in the form of an angle iron 30 to which is welded a metal plate 20 with a hole 21. This insert is illustrated in more detail in FIG. 6. The angle iron 30 has holes 31 which, when the insert is positioned on the sectional element, are situated opposite to holes 31' in the flanges 12, 13 of the sectional element. Pins 34 are inserted in the holes 31, 31'. The inserts are e.g. welded to the outside of the flanges 12, 13, with the metal plate 20 positioned in a recess 35 formed in the ends of the flanges 12, 13. For reasons given below, the pins 34 protrude a certain distance from the sides of the flanges 12, 13 which are facing away from one another or are facing outwards. If no inserts 30 are used, the metal plates 20 can instead be welded directly onto the centre flanges 12, 13 and the pins 34 be fixed in holes in the flanges 12, 13. In the hole 21, preferably in the metal plate 20 of the upper insert, there is fixed a pin, which fits in the hole 21 in the metal plate 20 of a superjacent cassette. This facilitates superimposing and orienting the cassettes with respect to each other. The angle irons can also be fixed by means of bolts extending through the holes 31 in the angle irons and the corresponding holes 31' in the centre flanges 12, 13 and projecting in the same manner as the pins. By means of the pins or bolts, it is then also possible to fix structural U-beams 32, formed with through holes 33 and forming part of the cassette, on the inside of the sectional elements 11 (see FIG. 7). Since the sectional element 11 is higher than the cassette 10, it projects, when connected to the cassette 10, slightly above the upper boundary plane of the cassette 10 and, in corresponding manner, projects just as much below the lower boundary plane of the cassette. The sectional element 11 can be connected to the cassette 10 in any desired manner. Owing to said upwardly and downwardly projecting portions, a space is formed, when one cassette 10 is placed on top of another cassette 10 with metal plates 20 applied against one another, between the superimposed cassettes. This space can be used for insulation, cabling etc. When one cassette 10 is thus placed on top of another, the orientation of the cassettes is facilitated by the pin which can be inserted in the opening 21.

Figure 3:
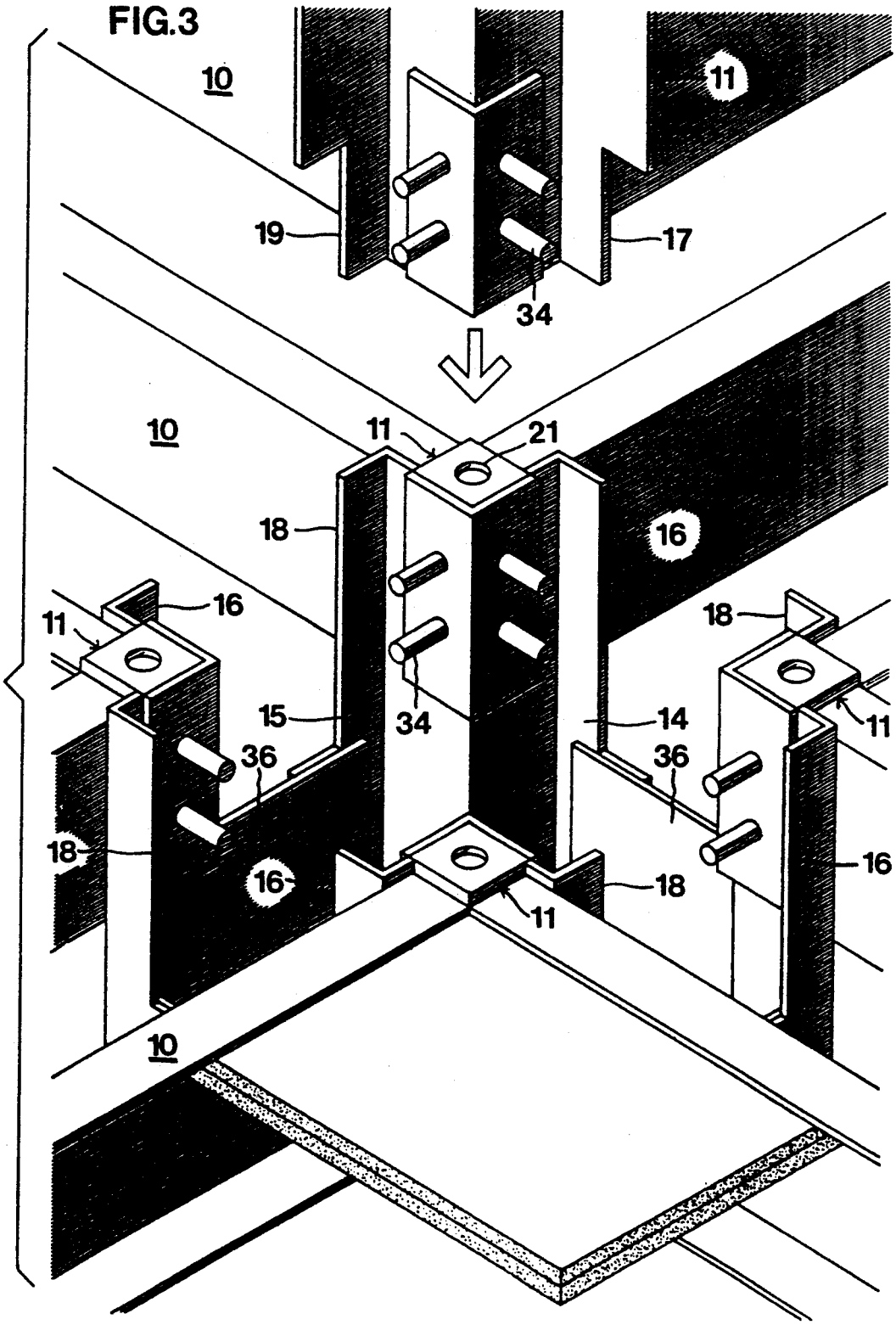

FIG. 3 illustrates how four cassettes of the type described above are placed at a slight distance from one another but with the free longitudinal edges of the sectional element flanges 14, 15 situated opposite to one another to define a vertical space, in which a column-casting material is to be applied. The longitudinal edges of the flanges 14, 15 may engage one another, but they are preferably arranged at a slight distance from one another, as shown in the Figure. A longitudinal metal sheet 36 is arranged on the outside of the flanges 14, 15, over the space between these flanges. The metal sheet 36 does not extend over the entire height of the sectional elements 11, but terminates on a level with the horizontal side of the recesses 16, 18; 17, 19, as shown in FIGS. 3 and 4. This metal sheet is, for instance, fixed by welding or riveting on the flanges 14, 15, but snap-on means are preferably used, such as elongate vertical holes in the flanges and vertically inclined ears on the metal sheet, these ears being pressed into the holes, such that the metal sheet is kept in place by combinated wedge and gravity action. This produces a locking and sealing effect. The recesses 16, 18 in the upper corners of the flanges define rectangular cut-outs, in which horizontal beams 23, preferably of concrete, are to be positioned, as shown in FIG. 4. To facilitate this operation, the beams 23 have vertically extending grooves 25, 26 located at a slight distance from the free beam ends and adapted to accommodate the longitudinal edges of the recesses 16, 18 to guide and keep in place the beams 23 and to provide sealing between the beams 23 and the flanges 14, 15. The beams 23 are equipped with anchoring means 24 projecting from the free beam ends, e.g reinforcing bars if the beams are made of concrete. As shown in FIG. 4, the recesses 16, 17; 18, 19 preferably have a total vertical extent corresponding to the height of the beam 23, for which reason the edge portions which define the lower recesses 17, 19 of a sectional element 11 belonging to a cassette 10 to be placed on top of another cassette, can be passed into the upper portion of the grooves 25, 26. When a given number of cassette layers have been stacked and horizontal beams 23 been arranged between all the layers, the column-casting material, e.g. concrete, is injected into the vertical form space which is defined by the four sectional elements 11 and the metal sheets 36, so as to engage the beams 23. Thus, the pins 34 and the anchoring means 24 of the beams are embedded in the column material. If required, vertical reinforcing bars may previously have been applied in the vertical space and, optionally, joined to the anchoring means 24 of the beams. It is obviously very easy to obtain in this manner a stable structural skeleton made up of vertical columns and horizontal beams 23 and supporting the building, for which reason the cassettes 10 need not take up any load. In a building, the lowermost cassettes need therefore not be any stronger than the uppermost cassettes. Preferably, the vertical supporting columns are made of concrete, but it is conceivable to use instead prefabricated beams, steel girders etc. in the space defined by the sectional elements 11, and interconnect these beams or girders by suitably designed horizontal beams.

As indicated above, the sectional elements of the cassettes 10 can be designed in many different ways. When the sectional elements 11 of two cassettes 10 are to be connected to e.g. an existing building 27, the two elements 11 may, as shown in FIG. 5, be connected to a sectional element 28 which is substantially U-shaped and connected, by means of suitable fixing means 20' to the outside of the building 27. Like the elements 11, the sectional element 28 may be formed with recesses in the upper and lower corners for receiving horizontal beams.

Thus, the invention makes it possible to erect buildings in a particularly simple and inexpensive way, while using as little material as possible, since the cassettes 10 and the associated sectional elements need not take up any load, except the dead weight and the useful load of the cassette, and since the sectional elements in an advantageous manner serve as formwork for producing the structural skeleton of the building. Further, it is easy to run piping and electric wiring in the spaces between the walls, floors and ceilings of adjacent cassettes. Also, expensive adjusting operations are not required, and once the stable skeleton has been completed or hardened, it is possible to move into the building.

We claim:

1. A method of erecting buildings using horizontal beams, room-forming cassettes of polygonal horizontal section which have vertically oriented sectional elements fixedly connected thereto, and a column-forming material such as concrete; each of said cassettes being located between and fixedly connected to at least two of said sectional elements, each of said sectional elements having flanges projecting from its periphery, said flanges having recesses for receiving said horizontal beams, said method including the following steps:

arranging the cassettes so that the flanges associated with their respective sectional elements define vertical cavities, placing end portions of said horizontal beams in said recesses in said flanges of the sectional elements, applying a column-forming material such as concrete in the vertical cavities to form supporting columns which engage the horizontal beams so that the supporting columns and horizontal beams constitute a supporting and stabilising structural skeleton with rigid assemblage points.

2. A structural assembly for erecting buildings, comprising, a plurality of vertically oriented sectional elements made of thin-walled material and having outer flanges projecting from their peripheries, a plurality of room-forming cassettes each of which is located between and is fixedly connected to at least two of said sectional elements, said outer flanges of said sectional elements having recesses for receiving horizontal beams, said sectional elements associated with adjacent cassettes being positionable close to each other to form a cavity which includes a horizontal beam received in said recesses so that a column forming material such as concrete, when cast in said cavity, engages the horizontal beam to form a supporting and stabilising structural skeleton with a rigid assemblage point.

3. The structural assembly of claim 2 wherein the sectional elements are made of sheet metal which has a strength sufficient to support the cassette during handling and to transmit dead weight and useful load of the cassette to underlying components in a final structure.

4. The structural assembly of claim 2 wherein each of the sectional elements ha tow centre flanges and two outer flanges forming a W-shaped cross-section, with mutually adjacent flanges extending at right angles to each other, said cassettes having corners received between said centre flanges.

5. The structural assembly of claim 2 wherein, in order to provide said recesses of the outer flanges of said sectional elements, said outer flanges of the sectional element each have a free long side and a free short side which define a corner which is cut off to form a recess, said recess having a first side parallel to said free long side and a second side parallel to said free short side, said recesses in sectional elements on adjacent cassettes being located where they together define a rectangular space for receiving an end portion of a horizontal arm; each of said sectional elements having an upper said recess and a lower said recess, said sectional elements having a second space therebetween which extend vertically from said second side of the upper said recess to said second side of the lower said recess, and a metal sheet covering said second space.

6. The structural assembly of claim 2 wherein said cassettes have upper and lower boundary planes, said sectional elements extending vertically beyond said boundary planes to act as spacers when cassettes are disposed in several planes on top of each other.

7. The structural assembly of claim 2 wherein the sectional elements have upper and lower ends, inserts which are connectible to the upper and lower ends of the sectional elements, each insert including a plate which has a hold, and a guide pin positionable in said holes to guide vertically adjacent cassettes when one cassette is placed on top of another.

8. The structural assembly of claim 2 wherein said outer flanges of the sectional element each have a free long side and a free short side which define a corner which is cut off to form a recess, said recess having a first side parallel to said free long side and a second side parallel to said free short side, said recesses of sectional elements on adjacent cassettes being located where they together define a rectangular space for receiving an end portion of a horizontal beam.

9. The structural assembly of claim 8 wherein each outer flange has said recesses located at its opposite ends, and said recesses on each outer flange have a total vertical extent corresponding to the vertical extent of the beam.

10. The structural assembly of claim 8 including a horizontal beam having an end portion which is positioned in said rectangular space, said beam having, adjacent said end portion, transverse grooves which receive edges of said sectional elements around said rectangular space, to guide the beam end when being positioned in the rectangular space and provide sealing between the beams and the flanges.

11. A structural assembly for erecting buildings, comprising, a plurality of vertically oriented sectional elements made of thin-walled material and having outer flanges projecting form their peripheries, a plurality of room-forming cassettes each of which is located between and is fixedly connected to at least two of said sectional elements, said outer flanges of said sectional elements having recesses for receiving horizontal beams, horizontal beams extending into said recess, said sectional elements associated with adjacent cassettes being positioned close to each other to form cavities which include horizontal beams received in said recesses, a column forming material such as concrete, cast in said cavities, said column-forming beam engaging the horizontal beams to form a supporting and stabilizing structural skeleton with rigid assemblage points.

* * * * *